United States Patent [19]

Terzian

[11] 4,232,478

[45] Nov. 11, 1980

[54] ANIMATED DOLL

[75] Inventor: Rouben T. Terzian, Chicago, Ill.

[73] Assignee: Marvin Glass & Associates, Chicago, Ill.

[21] Appl. No.: 10,835

[22] Filed: Feb. 9, 1979

[51] Int. Cl.[3] ..... A63H 13/02; A63H 11/00

[52] U.S. Cl. ..... 46/141; 46/135 R

[58] Field of Search ..... 46/141, 135 R

[56] References Cited

U.S. PATENT DOCUMENTS

| | | | |
|---|---|---|---|
| 3,005,283 | 10/1961 | Cohn | 46/141 |
| 3,092,929 | 6/1963 | Ostrander | 46/141 |
| 3,261,124 | 7/1966 | Bodenstein | 46/135 R |
| 4,033,071 | 7/1977 | Strongin et al. | 46/141 |
| 4,126,960 | 11/1978 | Guerrero | 46/135 R |

*Primary Examiner*—Robert Peshock
*Assistant Examiner*—Michael J. Foycik, Jr.
*Attorney, Agent, or Firm*—Mason, Kolehmainen, Rathburn & Wyss

[57] ABSTRACT

An animated doll includes a body having a head with a face including a mouth defined by lips formed of flexible material. An operator is secured to the lips behind the face and is reciprocated to move the lips inwardly and outwardly in a suckling type action. The nipple of a nursing bottle or the thumb of the doll's hand is manually insertable into the doll's mouth to provide realism when the lips are activated as described.

8 Claims, 4 Drawing Figures

Fig 1
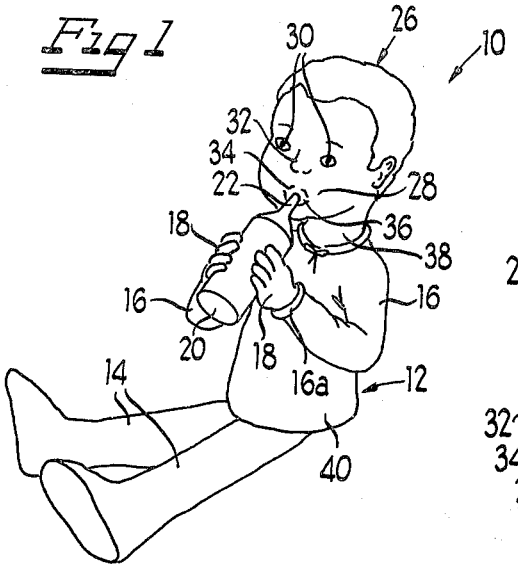
Fig 2
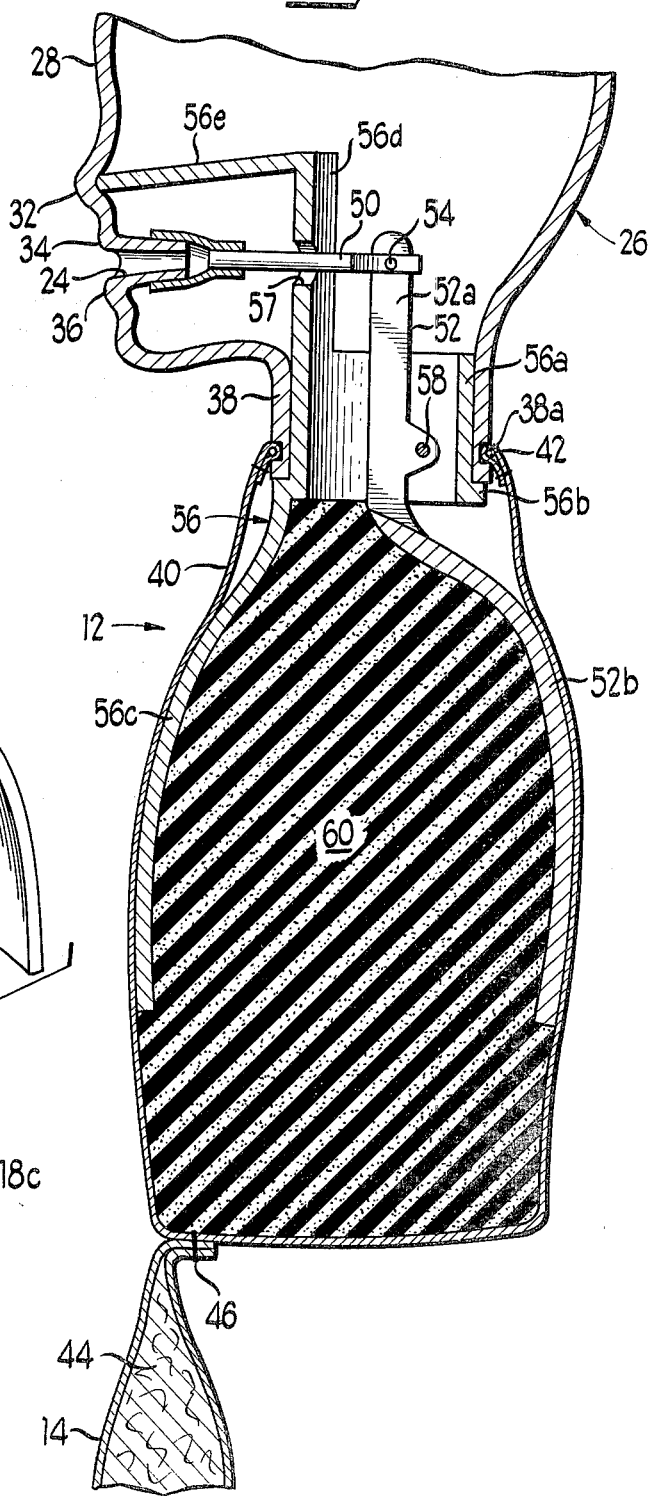
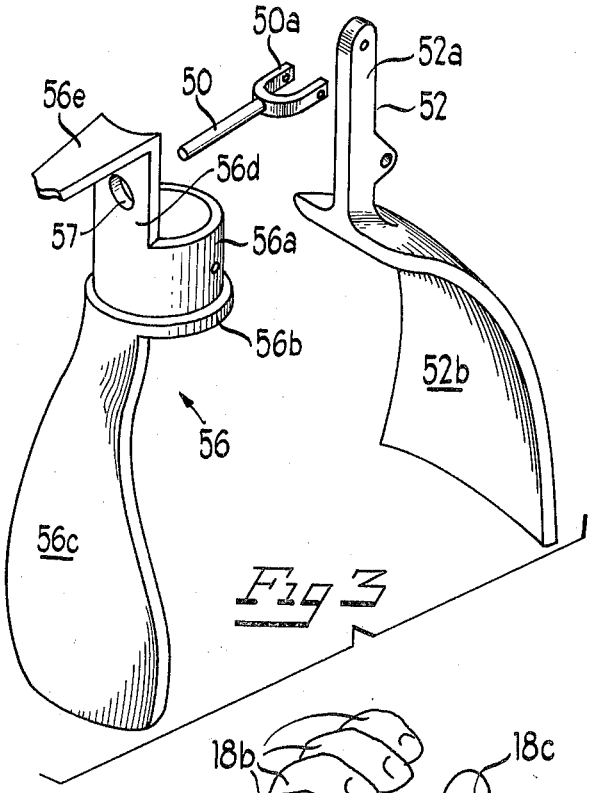
Fig 3
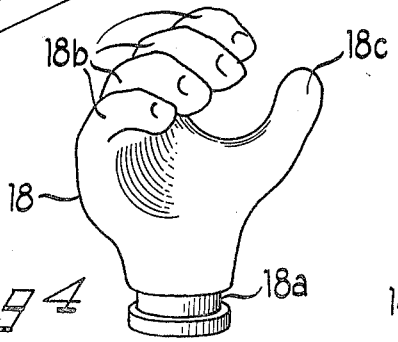
Fig 4

ANIMATED DOLL

BACKGROUND OF THE INVENTION

1. Field of the Invention

The present invention relates to a new and improved animated doll and more particularly to a baby doll which is manually activated to closely resemble a baby or young child nursing from a bottle or sucking its thumb.

2. Description of the Prior Art

A wide variety of animated dolls have been provided and some of the prior art dolls have been capable of animation resembling a young child or baby nursing from a bottle, sucking its thumb or eating a lollipop. U.S. Pat. Nos. 2,572,795; 3,092,292 and 3,911,614 disclose animated dolls of different constructions which are activated to simulate the real life actions of bottle nursing, thumbsucking and eating.

OBJECTS OF THE INVENTION

It is an object of the present invention to provide a new and improved animated doll which is operable to more realistically simulate the suckling type action of a young child or baby when nursing from a bottle or sucking its thumb.

Another object of the present invention is to provide a new and improved animated doll of the character described which is capable of closely simulating the action of nursing from a bottle which is held or supported in the doll's hand.

Yet another object of the present invention is to provide a new and improved realistic animated doll which is manually activated to provide thumb-sucking or nursing action by squeezing and releasing the doll's body.

Another object of the invention is to provide a new and improved animated doll of the character described having at least one movable arm with a hand especially adapted for holding a nursing bottle and provided with a thumb adapted to be inserted into the doll's mouth for thumbsucking action.

Yet another object of the present invention is to provide a new and improved animated nursing/thumbsucking doll which is low in cost, easy to operate and which provides a highly realistic simulation of a young child or baby nursing from a bottle or sucking its thumb.

BRIEF SUMMARY OF THE INVENTION

The foregoing and other objects and advantages of the present invention are accomplished in a new and improved, animated, nursing/thumbsucking doll which includes a body having a head with a face including a mouth defined by lips formed of flexible material. An operator is secured to the lips behind the face for reciprocation to move the lips inwardly and outwardly closely resembling a suckling type action. The doll is provided with at least one movable arm having a hand which is shaped to hold a nursing bottle with the nipple inserted into the doll's mouth. The doll's hand is also provided with a thumb designed to be inserted into the doll's mouth to provide thumb sucking action along with the doll's capability of nursing from a bottle.

BRIEF DESCRIPTION OF THE DRAWINGS

For a better understanding of the present invention, reference should be had to the following detailed description taken in conjunction with the drawings, in which:

FIG. 1 is a front perspective view of a new and improved, animated, nursing/thumbsucking doll constructed in accordance with the features of the present invention;

FIG. 2 is a longitudinal cross-sectional view of the doll of FIG. 1; and FIG. 3 is a front perspective view of an internal operating mechanism used for providing a nursing/thumbsucking action of the doll.

DESCRIPTION OF THE PREFERRED EMBODIMENT

Referring now more particularly to the drawings there is illustrated in FIG. 1 a perspective view of a new and improved, animated, nursing/thumbsucking doll referred to generally by the reference numeral 10 and constructed in accordance with the features of the present invention. The doll 10 includes a body 12 having a pair of legs 14 attached to a lower end portion and a pair of movable arms 16 having hands 18 (FIG. 4) adapted to hold a nursing bottle 20 in the position shown with a nipple 22 inserted into the mouth opening 24 of the doll's head 26.

The doll's head 26 is formed of thin, flexible, molded plastic material and is generally hollow including a frontal, facial wall 28 shaped to provide the usual facial features including a pair of eyes 30, a nose 32 and a pair of upper and lower lips 34 and 36 around the periphery of the mouth opening 24.

At the lower end, the doll's head 26 is formed with a depending neck 38 having an annular groove **38*a* on the outer surface, in which groove is seated the upper end or neck portion of an outer cover or wall 40 on the doll's body. The cover is preferably formed of thin flexible material such as cloth and is provided with a tie string 42** around the neck to secure the doll's body and the head together.

The legs and arms of the doll are similarly provided with an outer surface or cover formed of thin flexible material such as cloth and are filled with light stuffing material 44 as illustrated in FIG. 2. The legs 14 are attached to the doll's body by stitching 46 and a similar means of attachment is provided for the arms 16. The doll's hands 18 are formed of somewhat stiffer molded plastic material and each hand is formed with an annular groove **18*a* on the outer surface of a wrist portion for accommodating a connecting sleeve portion 16*a* on the arm which is secured by means of a drawstring in a manner similar to (not shown) the drawstring or tie string 42**.

At least one hand is shaped with curved fingers **18*b* as shown and an oppositely curved thumb 18*c* which are adapted to form a recess for accommodating and holding the nursing bottle 20 which is inserted between the thumb and fingers as illustrated in FIG. 1. The thumb 18*c* is also dimensioned to be inserted into the doll's mouth opening 24 in a manner similar to the insertion of the nipple 22 of the nursing bottle 20**.

The hand 18 is selectively positioned by manual rotation on its supporting arm 16 and this permits the hand to be properly positioned, either for holding the nursing bottle, or in the alternative for thumbsucking with the thumb **18*c* inserted in the doll's mouth 24**.

In accordance with the present invention, the flexible plastic material of the facial wall 28 of the doll's head 26 is integrally formed to extend inwardly from the outer lips 34 and 36 to form a hollow tubular mouth sleeve which projects inwardly for some distance into the interior of the hollow head 26 as illustrated.

An attachment element 48 is connected to the inner end of the tubular mouth sleeve and the attachment is secured to the forward end portion of an actuator rod 50. The actuator rod is pivotally interconnected at its rearward or inner end to the upper end 52*a* of an actuating lever 52 which projects downwardly through the neck 38 into the interior of the doll's body.

As illustrated best in FIG. 3, the actuator rod 50 includes a yoke 50*a* at the inner end having a pair of legs disposed on opposite sides of the upper end portion 52*a* of the actuator lever 52, and the yoke is pivotally interconnected to the lever by a pivot pin 54.

In accordance with the invention, the doll 10 includes an internal stiffening member 56 having an annular base comprising a cylindrical sleeve 56*a* which extends upwardly into the neck 38 in the hollow head 26 of the doll as illustrated. The base sleeve 56*a* is formed with an outwardly extending integral annular flange 56*b* at the lower end and the lower edge of the neck 38 is seated against the upper surface of the flange as shown. The stiffening member also includes an enlarged, forward wall portion 56*c* extending downwardly of the sleeve or base 56*a* and shaped to lie closely adjacent the outer wall cover 40 of the doll's body as illustrated in FIG. 2. In addition, the internal stiffener includes an upwardly extending post 56*d* having a circular opening 57 therein for accommodating the outer end portion of the actuator rod 50. At the upper end of the post 56*d* an outwardly extending, nose stiffening element 56*e* is integrally formed and this element engages the inside surface of the facial wall 28 in the area of the doll's nose 32 as illustrated in FIG. 2. The nose stiffening element prevents inward retraction of the nose portion and the upper facial wall in general as the lips of the doll's mouth 24 are moved inwardly and outwardly by reciprocation of the actuator rod 50.

The actuator lever 52 is pivotally supported intermediate its ends on a transverse pin 58 carried by the annular base 56*a* of the stiffener and is rockable back and forth. The lever includes a handle portion 52*b* extending downwardly from the pivot pin 58 and this handle portion is enlarged and shaped to match and lie closely adjacent the outer surface of the doll's body wall 40 on the rear or backside thereof. Between the relatively stiff, front wall stiffener 56*c* and the handle 52*b*, the doll's body is filled with a compressible foam rubber material 60 which tends to maintain the handle 52*b* in the position as shown. The portions 56*c* and 52*b* provide a relatively stiff front and back wall support or shell for the body of the doll and permit the body to be squeezed and released on a repetitive basis compressing the foam material 60 each cycle. When squeezing pressure is released, the foam returns the elements 56*a* and 52*b* to the normal position as shown. Squeezing and release of the doll's body activates the lips 34 and 36 of the mouth 24 to simulate a suckling type action including nursing from the nipple 22 of the inserted nursing bottle 20 or thumbsucking with the thumb 18*c* of one of the doll's hands 18 inserted into the doll's mouth. The foam rubber material 60 within the doll's body resiliently biases the rear wall handle 52*b* of the actuating lever 52 outwardly away from the front wall portion 56*c* toward the normal position as shown, each time the squeezing pressure on the doll's body is released. In addition, the foam 60 serves to provide the desired body shape inside the cover 40.

From the foregoing it will be seen that the animated nursing thumbsucking doll 10, constructed in accordance with the present invention is realistic in appearance and closely simulates the real life, suckling type action of a young child or baby while nursing or thumb sucking.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. An animated doll capable of suckling a member telescoped within said doll comprising:

a body having a head with a face including a mouth defined by spaced apart lips formed of flexible material and a tubular mouth sleeve extending from said lips inwardly into the interior of said head;

manually operable means connected to said lips and said mouth sleeve behind said face, said manually operable means being reciprocally movable to move said lips inwardly and outwardly with respect to said face in a suckling type action and to move said mouth sleeve generally in a direction parallel to its axis, said operator means including a reciprocal actuator, engaging said sleeve;

said head including an outer facial wall of thin flexible plastic material, said head being a hollow enclosure having stiffening means internally of said head engaging said facial wall in a position spaced apart from said mouth for preventing retractive movement of said facial wall away from said mouth when said actuator is operatively moving said tubular mouth sleeve inwardly and outwardly; and means connected to said body for defining a member for insertion within said tubular mouth sleeve of said doll during the reciprocal movement of said lips.

2. The doll of claim 1 wherein said actuator includes a first element reciprocal longitudinally in a direction extending inward of said facial wall and including a second element mounted for pivotal movement and connected to reciprocate said first element upon rocking movement of said second element, said second element including a handle portion adjacent an outer surface of said body of said doll adapted for movement in response to force applied on said surface to initiate said rocking movement to move said lips.

3. The doll of claim 2 including resilient means for biasing said handle portion to move in a direction opposite that of said applied force, said resilient means being a body of compressible resilient material.

4. The doll of claim 1 including at least one movable arm on said body having a hand with a finger thereon adapted for insertion in said mouth.

5. The doll of claim 1 including in combination a nursing bottle having a nipple at one end adapted for insertion in said mouth.

6. The combination of claim 5 wherein said doll includes at least one movable arm on said body having a hand with fingers adapted to hold said nursing bottle when said bottle is positioned with said nipple inserted in said mouth.

7. The combination of claim 6 wherein at least one of said fingers is adapted to be inserted in said mouth.

8. The combination of claim 6 wherein said hand is mounted on said arm for rotative movement about a longitudinal axis of an adjacent portion of said arm to manually selected relative rotational position on said adjacent portion.

* * * * *